US009132651B2

(12) United States Patent
Ota et al.

(10) Patent No.: US 9,132,651 B2
(45) Date of Patent: Sep. 15, 2015

(54) SEAL MEMBER FOR SEALING SUPPLY PORT OF INK TANK AND INK TANK UNIT INCLUDING SEAL MEMBER

(71) Applicant: CANON KABUSHIKI KAISHA, Tokyo (JP)

(72) Inventors: Hirofumi Ota, Yokohama (JP); Hiroshi Inomata, Yokohama (JP); Katsumi Eda, Hino (JP); Hiroki Hayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/841,571

(22) Filed: Mar. 15, 2013

(65) Prior Publication Data

US 2013/0265373 A1 Oct. 10, 2013

(30) Foreign Application Priority Data

Apr. 4, 2012 (JP) ..... 2012-085546

(51) Int. Cl.
*B41J 2/175* (2006.01)
*B41J 2/17* (2006.01)

(52) U.S. Cl.
CPC ..... *B41J 2/17523* (2013.01); *B41J 2/17536* (2013.01)

(58) Field of Classification Search
CPC .. B41J 2/17553; B41J 2/17523; B41J 2/1652; B41J 2/17533; B41J 2/175; B41J 2/17536
USPC ..... 347/84, 85, 86, 29, 31
See application file for complete search history.

(56) References Cited

U.S. PATENT DOCUMENTS

| | | | | |
|---|---|---|---|---|
| 6,412,933 | B2 * | 7/2002 | Umemura et al. | 347/86 |
| 6,422,692 | B2 * | 7/2002 | Yamazaki et al. | 347/86 |
| 2007/0030302 | A1 * | 2/2007 | Yamada | 347/31 |
| 2008/0204525 | A1 * | 8/2008 | Warren et al. | 347/86 |

FOREIGN PATENT DOCUMENTS

JP 09-286113 A 11/1997

* cited by examiner

*Primary Examiner* — Jannelle M Lebron
(74) *Attorney, Agent, or Firm* — Canon USA Inc IP Division

(57) ABSTRACT

A seal member configured to seal a supply port for supplying ink contained in an ink tank to an outside of the ink tank is provided. The seal member includes a first area corresponding to the supply port and an ink absorbing member disposed in a second area located outside the first area.

7 Claims, 9 Drawing Sheets

SEAL MEMBER FOR SEALING SUPPLY PORT OF INK TANK AND INK TANK UNIT INCLUDING SEAL MEMBER

BACKGROUND OF THE INVENTION

1. Field of the Invention

The present disclosure relates to a seal member for sealing a supply port of an ink tank used in an inkjet printing apparatus and an ink tank unit including a supply port sealed by the seal member.

2. Description of the Related Art

One of two types of ink tank is mounted in an inkjet printing apparatus: an ink tank of an integrated type that is integrally provided in an ejection head for ejecting ink onto a recording medium or an ink tank of a separate type that is provided separately from an ejection head.

In general, ink tanks of a separate type are stored in the form of ink tank units until the ink tanks are mounted in inkjet printing apparatuses. The ink tank unit has a seal member for sealing a supply port used for supplying ink. The seal member is bonded to the supply port.

Japanese Patent Laid-Open No. 09-286113 describes such a seal member for sealing a supply port. As illustrated in FIG. 9, the seal member has an adhesive substrate 1003 having an ink absorbing member 1002 embedded in a supply port 1001 of an ink tank 1000.

However, the seal member described in Japanese Patent Laid-Open No. 09-286113 absorbs a large amount of ink while being distributed and sold. Accordingly, when the ink tank is unsealed, ink that the ink absorbing member cannot preserve spills out. The spilled-out ink may be scattered and, thus, may be transferred to the arms, clothes of a user.

SUMMARY OF THE INVENTION

According to an embodiment of the present disclosure, a seal member that seals a supply port for supplying ink contained in an ink tank to an outside includes a first area corresponding to the supply port and an ink absorbing member disposed in a second area located outside the first area.

Further features will become apparent from the following description of exemplary embodiments with reference to the attached drawings.

DESCRIPTION OF THE EMBODIMENTS

In the following exemplary embodiments, a seal member that seals a supply port of an ink tank has an ink absorbing member disposed in an outer area of the supply port, not in an inner area. As used herein, the term "outer area of a supply port" refers to, when the seal member seals the supply port, an area of the seal member that is not in contact with the inner area of the supply port. That is, in consideration of walls that form the supply port, an "inner area of the supply port" is defined as an area inside the inner wall that forms the supply port, and an "outer area of a supply port" is defined as an area of the seal member outside the outer wall that forms the supply port.

Exemplary embodiments are described below with reference to the accompanying drawings.

First Exemplary Embodiment

Figure 1A:
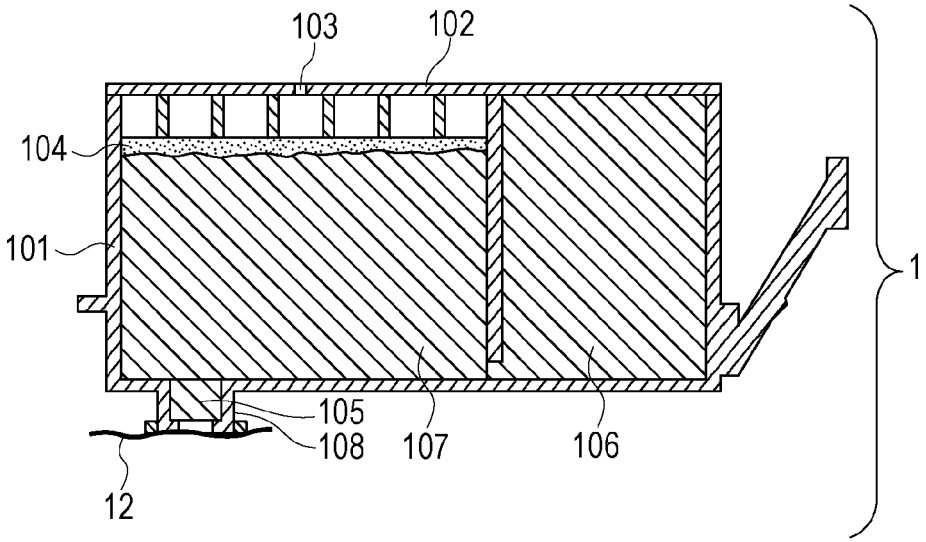
FIG. 1A is a cross-sectional view schematically illustrating an ink tank unit according to a first exemplary embodiment.
Figure 1B:
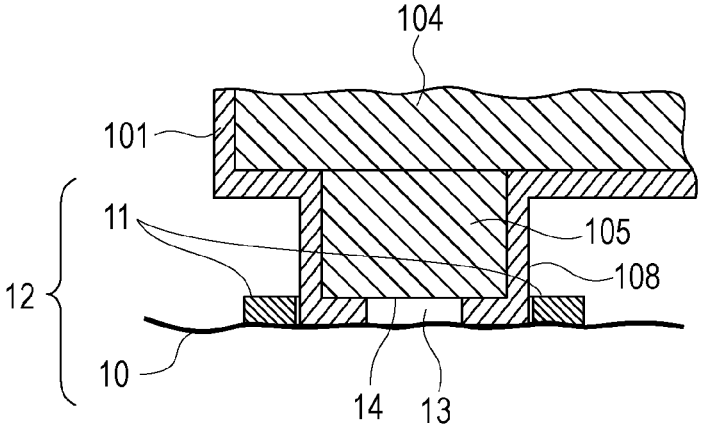
FIG. 1B is an enlarged cross-sectional view of a supply port of the ink tank unit and its vicinity illustrated in FIG. 1A.

FIG. 1A is a cross-sectional view schematically illustrating an ink tank unit according to a first exemplary embodiment. FIG. 1B is an enlarged cross-sectional view of a supply port of the ink tank unit and its vicinity illustrated in FIG. 1A.

As illustrated in FIG. 1A, an ink tank unit 1 includes an ink tank body 101 and a seal member 12 that seals an opening of a supply port 108 having a cylindrical shape. The supply port 108 supplies ink to the outside of the ink tank unit 1. The inside of the ink tank body 101 is separated into two by a partition wall and, thus, the supply port 108 has an ink containing chamber 106 and an absorber holder 107. In the upper section of the absorber holder 107, a cover member 102 has an air communication port 103. The air communication port 103 communicates with atmosphere. In the lower section of the absorber holder 107, the supply port 108 is disposed. The supply port 108 is connected to an inkjet print head (not illustrated) and supplies ink to the inkjet print head. The ink containing chamber 106 communicates with the absorber holder 107 via a gas-liquid exchange channel formed in the lower portion of the partition wall. Ink supplied from the ink containing chamber 106 via the gas-liquid exchange channel is absorbed and preserved by a porous absorbent 104 disposed in the absorber holder 107. The porous absorbent 104 has a capillary force. In addition, an air introduction groove (not illustrated) is formed in a portion of the partition wall adjacent to the absorber holder 107 so as to reach the gas-liquid exchange channel. Thus, air flows from the air communication port 103 into the ink containing chamber 106 through the air introduction groove. In this manner, gas-liquid exchange is performed so that ink is supplied from the ink containing chamber 106 to the absorber holder 107 via the air communication port 103. It is desirable that the porous absorbent 104 have a double member structure including two types of porous members having different capillary forces. One of the members in the upper layer includes a porous material having a relatively small capillary force, and the other in the lower layer includes a porous material having a relatively large capillary force. By employing such a structure, ink is sucked downward and, thus, the ink is excellently supplied to the supply port 108. The supply port 108 has a pressure contact member 105 press-fitted thereinto. The pressure contact member 105 has a capillary force larger than that of the porous absorbent 104. The pressure contact member 105 draws the ink absorbed and preserved in the porous absorbent 104 into the supply port 108. In this manner, the ink is supplied to the print head connected to the ink tank unit 1.

As illustrated in FIG. 1B, when the supply port 108 is sealed by the seal member 12, a cavity portion 13 is formed between the bottom face 14 of the pressure contact member 105 and the seal member 12.

Figure 2:
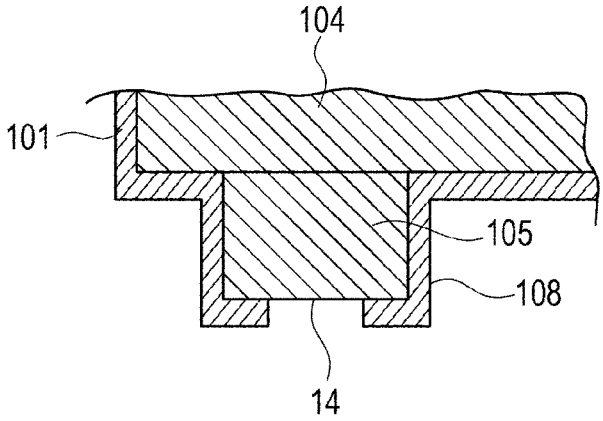
FIG. 2 is an enlarged cross-sectional view of the supply port of an unsealed ink tank body and its vicinity.

FIG. 2 is an enlarged cross-sectional view of the supply port of an unsealed ink tank body and its vicinity. The bottom face 14 of the pressure contact member 105 is exposed to the outside when the seal member 12 that seals the supply port 108 during the distribution stage is peeled off the ink tank unit 1. The ink tank body 101 supplies ink through the exposed bottom face 14 of the pressure contact member 105.

Figure 3A:
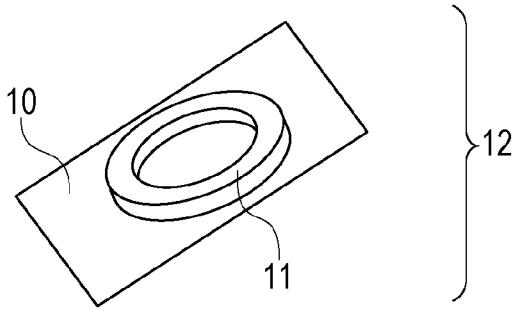
FIG. 3A is a perspective view schematically illustrating a seal member according to the first exemplary embodiment.
Figure 3B:
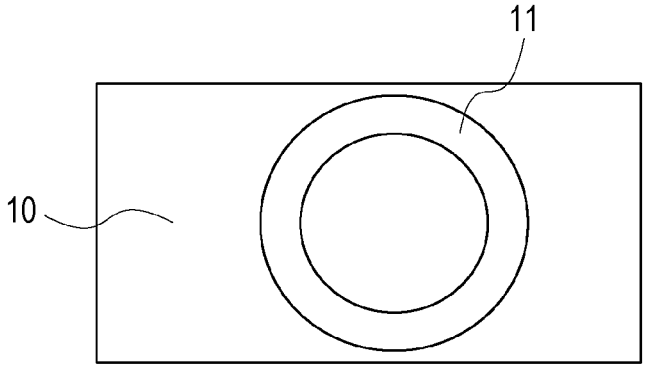
FIG. 3B is a top view of the seal member according to the first exemplary embodiment.
Figure 3C:
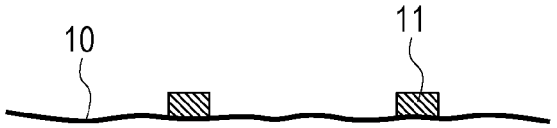
FIG. 3C is a cross-sectional view of the seal member according to the first exemplary embodiment.

FIG. 3A is a perspective view schematically illustrating the seal member according to the first exemplary embodiment. FIG. 3B is a top view of the seal member according to the first exemplary embodiment. FIG. 3C is a cross-sectional view of the seal member according to the first exemplary embodiment.

As illustrated in FIG. 3A, the seal member 12 includes an ink absorbing member 11 capable of absorbing ink and a viscous base member 10 having viscosity for allowing the ink absorbing member 11 to be attached on a surface thereof. A commercially available easy-peel film is used as the viscous base member 10 that can be easily peeled from the ink tank body 101 formed of a plastic material. Such an easy-peel film serves as the seal member including a polyethylene terephthalate (PET) base member, a polypropylene (PP) holding layer, and a polypropylene (PP) and polyethylene (PE) pressure sensitive adhesive layer stacked on top of each other. Note that the materials of the viscous base member 10 are not limited thereto. Any appropriate materials may be employed for the ink tank body 101.

As another example, the viscous base member 10 including a thermoplastic base member and an acrylic polymer pressure sensitive adhesive layer may be employed. As still another example, the viscous base member 10 including a PET base member and an ethylene-vinyl acetate (EVA) copolymer pressure sensitive adhesive layer may be employed.

For example, a thermally compressed PP fiber having a void ratio of 25% may be used as the ink absorbing member 11. Such a fiber can efficiently absorb ink. As used herein, the term "void ratio" refers to the ratio of the volume of the cavity portion to the total volume of the absorbing member. Note that the material used for the ink absorbing member 11 is not limited thereto. For example, a porous material, such as an urethane foam, may be employed. That is, an appropriate material can be employed in accordance with the material of ink.

According to the present exemplary embodiment, the ink absorbing member 11 is joined to the base member (PET) of the viscous base member 10 by thermal welding. However, the joining technique is not limited thereto. For example, the ink absorbing member 11 may be joined to the base member using an adhesive agent or by embedding the ink absorbing member 11 into the base member.

Figure 4:
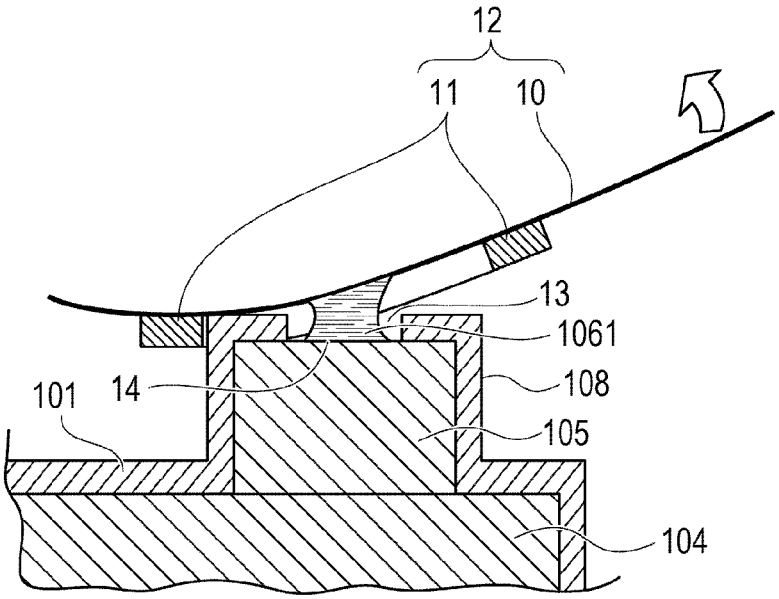
FIG. 4 is an enlarged cross-sectional view of the supply port of the unsealed ink tank unit and its vicinity.
Figure 5:
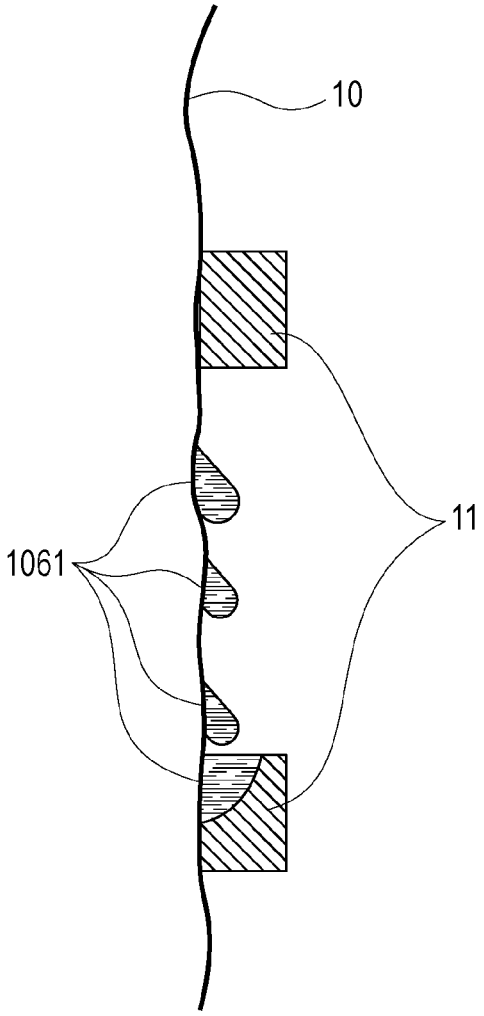
FIG. 5 is an enlarged cross-sectional view of the supply port of the ink tank unit and its vicinity immediately after a seal is removed.

FIG. 4 is an enlarged cross-sectional view of the supply port of the unsealed ink tank unit and its vicinity. FIG. 5 is an enlarged cross-sectional view of the supply port of the ink tank unit and its vicinity immediately after the seal is removed. When the seal member is removed, the seal member efficiently traps excess ink leaked out of the supply port. Such a mechanism of the seal member is described next with reference to FIGS. 4 and 5.

As illustrated in FIG. 4, in the ink tank unit which has been stored for a long time, excess ink 1061 leaked out of the pressure contact member 105 may be accumulated in the cavity portion 13 formed between the bottom face 14 of the pressure contact member 105 press-fitted into the supply port 108 and the seal member 12.

When the ink tank unit is unsealed, that is, the end of the seal member 12 is pulled up and is peeled off in a direction indicated by an arrow illustrated in FIG. 4, the excess ink 1061 accumulated in the cavity portion 13 can be separated into ink left on the seal member 12 and ink left on the bottom face 14 of the pressure contact member 105. As illustrated in FIG. 5, after the ink is separated in this manner, the excess ink 1061 left on the seal member 12 flows in a direction away from a point at which the seal member 12 is pulled up. Thereafter, the excess ink 1061 is absorbed by part of the ink absorbing member 11. In this manner, by disposing the ink absorbing member in an area outside the supply port, the seal member 12 can lead the excess ink to the ink absorbing member during seal removal. At that time, the ink absorbing member has a sufficient ink absorbing ability, since the ink absorbing member is disposed outside the supply port without being in contact with ink and under drying conditions while being distributed and sold. Accordingly, ink is naturally drawn into the inside of the ink absorbing member and, thus, leakage of ink from the ink absorbing member and transfer of the leaked ink to the arms, clothes of a user can be prevented.

According to the present exemplary embodiment, as illustrated in FIG. 3A, the ink absorbing member 11 is formed so as to have a ring shape. In addition, as illustrated in FIG. 1B, the ink absorbing member 11 is formed along the outer wall of the supply port 108. Since the supply port of the ink tank body 101 has an outer diameter of 11 mm, the inner diameter of the ink absorbing member is set to, for example, 11 mm so that any gap is not formed between the ink absorbing member and the supply port. The thickness of the ink absorbing member is 2 mm.

It is desirable that the outer diameter and the thickness of the ink absorbing member be set so that when the cavity portion 13 is completely filled with ink, the ink absorbing member can contain the volume of the entire ink in the cavity portion 13. It is more desirable that the ink absorbing member have a capacity that can contain double the full amount of ink in the cavity portion 13 or more. If the ink absorbing member has such a margin that the ink absorbing member can contain double the full amount of ink in the cavity portion 13, the ink absorption speed can be increased in addition to the increase in an absorbed ink volume. Thus, the reliability of trapping ink can be significantly increased.

While the present exemplary embodiment has been described with reference to a ring-shaped ink absorbing member, any shape can be employed if the shape allows the ink absorbing member to be disposed in an area outside the supply port, where the ink absorbing member is not in contact with ink during the distribution of the ink tank unit.

It is desirable that the ink absorbing member be disposed so as to surround the supply port. Note that at that time, the ink absorbing member need not be disposed so as to continuously and completely surround the supply port. For example, a plurality of the ink absorbing members may be disposed at such positions that the ink absorbing members face the outer wall of the supply port and, thus, the ink absorbing members discontinuously surround the supply port.

In this case, even when ink accumulated in the cavity portion flows down during seal removal, the ink is trapped by any one of the ink absorbing members disposed so as to surround the supply port. Thus, the ink can be reliably absorbed.

In addition, it is desirable that the ink absorbing member be disposed along the outer wall of the supply port without a gap therebetween. Such an ink absorbing member can absorb and hold ink that is accumulated in the cavity portion during the distribution of the ink tank unit and that is leaked out of the cavity portion through a gap formed in the viscous base member 10 for sealing the supply port during seal removal. Thus, the reliability for preventing ink leakage can be increased.

As described above, in order to allow the excess ink to more smoothly move on the viscous base member 10 during seal removal, the surface of the viscous base member 10 may have water repellency by, for example, having water-repelling liquid applied thereto.

Second Exemplary Embodiment

Figure 6:
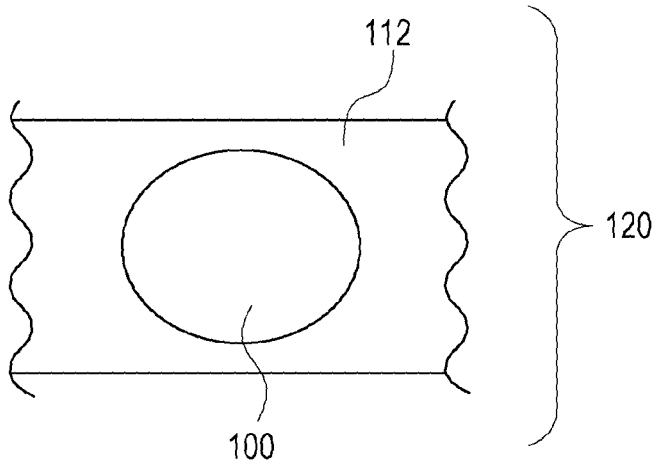
FIG. 6 is a top view schematically illustrating a seal member according to a second exemplary embodiment.

FIG. 6 is a top view schematically illustrating a seal member according to a second exemplary embodiment. According to the second exemplary embodiment, as illustrated in FIG. 6, a plate-like ink absorbing member 112 is disposed on a seal member 120 so as to cover the entire surface of the seal member 120 except for an area 100 corresponding to the supply port. When the supply port is sealed using the seal member 120, only the opening edge of the supply port is bonded to the viscous base member 10. Accordingly, the area of a bonded surface is relatively small. Therefore, in order to maintain the bond strength, the viscous base member 10 needs to have a sufficient adhesive power. The outer diameter of the area 100 of the ink absorbing member 112 is, for example, 11 mm, which is the same as the inner diameter of the ink absorbing member 11 according to the first exemplary embodiment.

As described above, according to the second exemplary embodiment, the seal member can be achieved by cutting out a circular portion of the plate-like ink absorbing member along the opening edge of the supply port and, subsequently, bonding the ink absorbing member onto the viscous base member. Such a seal member in which the ink absorbing member spreads over the entire surface of the seal member can absorb a more amount of ink. Even when a large amount of excess ink is accumulated, the ink absorbing member can reliably hold the ink. Thus, the reliability of the seal member can be increased.

Third Exemplary Embodiment

Figure 7A:
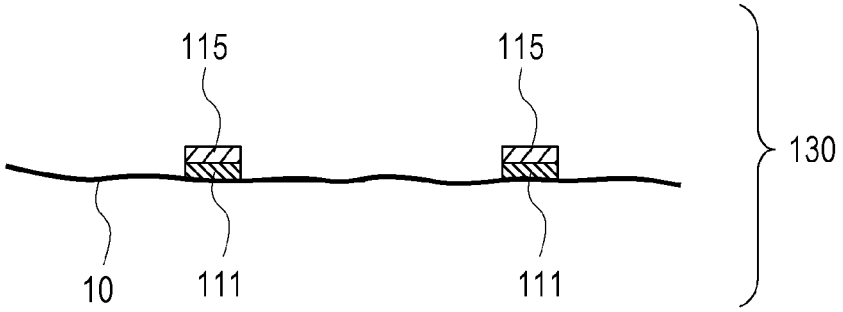
FIGS. 7A and 7B are cross-sectional views schematically illustrating seal members according to a third exemplary embodiment.
Figure 7B:
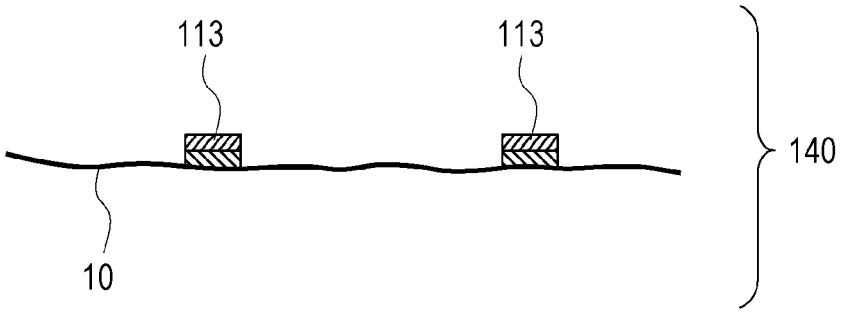

FIG. 7A is a cross-sectional view schematically illustrating a seal member according to a third exemplary embodiment. FIG. 7B is a cross-sectional view of a modification of the third exemplary embodiment. Like the first exemplary embodiment, according to the third exemplary embodiment, the seal member has a ring shape formed along the outer wall of the supply port.

According to the third exemplary embodiment, as illustrated in FIG. 7A, a seal member 130 is formed as a two-layer seal member by stacking two different types of ink absorbing members. Such a two-layer seal member includes a high-density first ink absorbing member 111 as a lower layer and a low-density second ink absorbing member 115 as a higher layer. The first ink absorbing member 111 is in contact with the viscous base member 10, and the second ink absorbing member 115 is stacked on top of the first ink absorbing member 111. Such a structure allows excess ink to flow on the viscous base member 10 during seal removal. Thereafter, when the ink is trapped by the ink absorbing member, the ink naturally permeates from the higher layer to the lower layer. Thus, a negligible amount of ink remains on the front surface of the ink absorbing member that is easily touched by the user.

According to a modification of the third exemplary embodiment, as illustrated in FIG. 7B, a seal member 140 is a two-layer seal member that is similar to the seal member of the third exemplary embodiment. Like the third exemplary embodiment, the seal member 140 includes two types of ink absorbing members stacked into two layers.

Such a two-layer seal member includes an ink absorbing member 113 in the higher layer. The ink absorbing member 113 is made of, for example, curable resin. Examples of the curable resin include a UV-curable resin and a thermoset resin. However, any curable resin may be used. Such a curable ink absorbing member disposed in the higher layer that forms the front surface prevents ink trapped and held from leaking out of the front surface. Accordingly, the ink is negligibly transferred to the arms and clothes of the user. Alternatively, instead of the two-layer structure, the ink absorbing member may be formed as a single layer, and only the surface of the ink absorbing member may be cured.

According to the third exemplary embodiment, the material of the higher layer that forms the front surface of the ink absorbing member differs from the material of the lower layer so that the lower layer is easily impregnated with trapped ink. In this manner, the ink negligibly remains on the surface of the seal member. Thus, the ink is negligibly transferred to the arms and clothes of a user.

Fourth Exemplary Embodiment

Figure 8A:
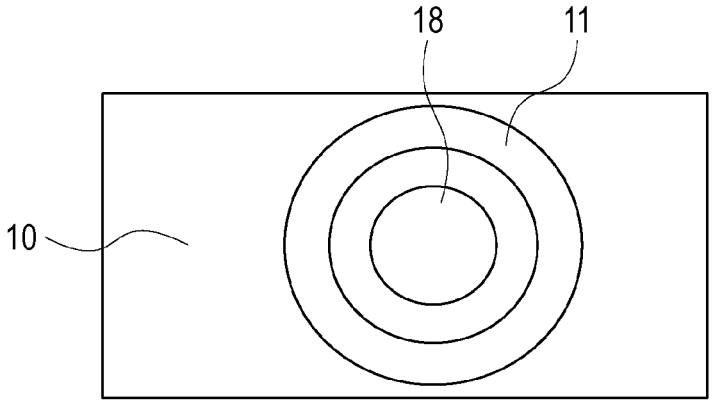
FIGS. 8A to 8C are schematic illustrations of a seal member according to a fourth exemplary embodiment.
Figure 8B:
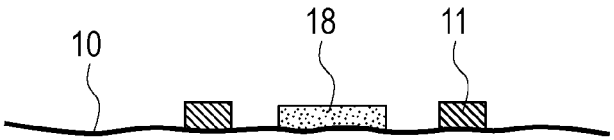
Figure 8C:
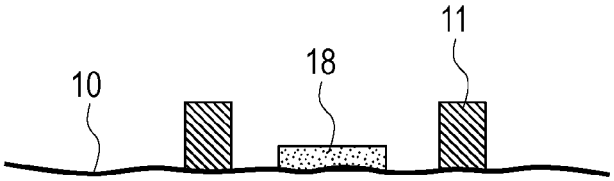
Figure 9:
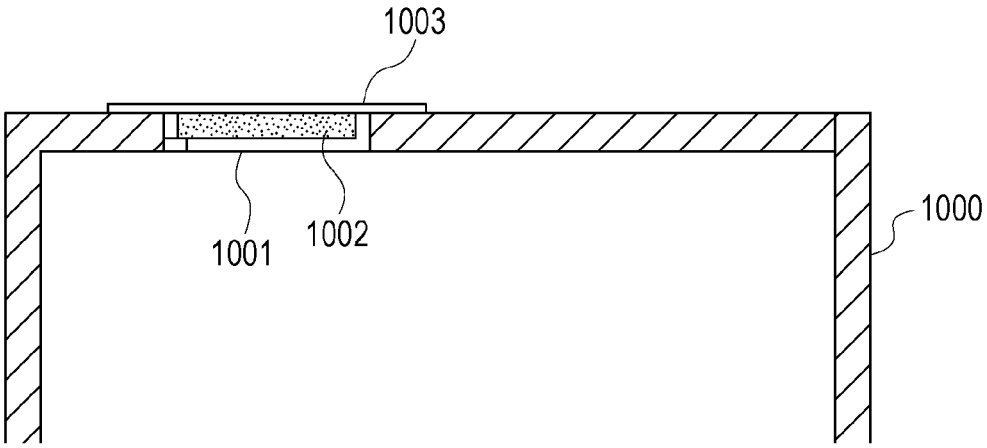
FIG. 9 is an enlarged cross-sectional view of a supply port of an ink tank unit sealed by an existing seal member and its vicinity.

FIG. 8A is a top view schematically illustrating a seal member according to a fourth exemplary embodiment. FIGS. 8B and 8C are cross-sectional views of modifications of the fourth exemplary embodiment.

As illustrated in FIGS. 8A to 8C, like the first exemplary embodiment, according to the fourth exemplary embodiment, an ink absorbing member includes a ring-shaped ink absorbing member 11 formed in an area outside the supply port along the outer wall of the supply port. In addition, according to the present exemplary embodiment, an ink absorbing member 18 is disposed in an area inside the inner wall of the supply port.

In such a structure, that is, the structure in which the ink absorbing member is disposed even inside the supply port, at least part of excess ink is absorbed and held by the ink absorbing member 18 and, thus, the amount of ink leaking out during seal removal can be reduced. Accordingly, the case in which when a large amount of ink instantaneously leaks out and the ink absorbing member 11 disposed in the area outside the supply port cannot trap all of the ink negligibly occurs. As a result, the ink is negligibly transferred to the arms and clothes of a user. Thus, a reliable ink tank unit can be provided.

As illustrated in FIG. 8C, a seal member according to a modification of the fourth exemplary embodiment includes the ink absorbing member 18 having a thickness (illustrated in FIG. 8B) that is smaller than that of the ink absorbing member 11. By reducing the thickness (the height) of the ink absorbing member 18 disposed inside the ink absorbing member 18 to less than that of the ink absorbing member 11 disposed in an area outside the supply port, the ink absorbing member 11 serves as a barrier that prevents a user from touching the ink absorbing member 18 that holds absorbed ink. In this manner, the finger of the user does not touch the ink absorbing member 18 that absorbs and holds a large amount of ink. While the above-described exemplary embodiments have been described with reference to the seal member 12 that is attached to the ink tank body 101 using the viscous base member 10 provided on the seal member 12, a method for attaching the seal member 12 to the ink tank body 101 is not limited thereto. For example, a seal member made from a PET or PP film member may be attached to an ink tank body using a welding process. In such a case, for example, the edge portion of the supply port 108 can be brought into contact with the seal member 12. Thereafter, the edge portion of the supply port 108 and the seal member 12 can be welded using ultrasonic welding or thermal welding. Subsequently, the ink absorbing member 11 can be formed around the weld portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-085546 filed Apr. 4, 2012, which is hereby incorporated by reference herein in its entirety.

What is claimed is:

1. A seal member that seals a supply port for supplying ink contained in an ink tank to an outside, comprising:

a film member, a surface of which has an adhesive layer;

a first area formed on the film member, the first area corresponding to the supply port; and an ink absorbing member formed of a porous material and disposed in a second area located outside the first area, external to the ink tank, and adjacent the supply port, and a third area located between the first area and the second area on the film member, the third area including the adhesive layer, and adhered to the ink tank, wherein the seal member is configured to seal the supply port of the ink tank during distribution of the ink tank and is separated from the ink tank before the ink tank is attached to an apparatus.

2. The seal member according to claim 1, wherein the ink absorbing member contains a fiber or an urethane foam.

3. The seal member according to claim 1, wherein the ink absorbing member is not provided at a position of the first area opposite to the supply port.

4. An ink tank unit comprising:

an ink tank including a supply port configured to supply ink to an outside; and the seal member according to claim 1.

5. The ink tank unit according to claim 4, wherein an edge portion of the supply port and the film member are welded together.

6. The ink tank unit according to claim 4, wherein each of the weld portion and the ink absorbing member has a ring shape.

7. The ink tank unit according to claim 4, wherein the supply port has a cylindrical shape, and a side surface of the cylindrical shape is in contact with the ink absorbing member.

* * * * *